US008499532B2

(12) United States Patent
Park et al.

(10) Patent No.: US 8,499,532 B2
(45) Date of Patent: Aug. 6, 2013

(54) SYSTEM AND METHOD FOR SEALING PACKING CONTAINERS

(75) Inventors: Kevin William Park, Chardon, OH (US); Paul Francis Deimling, Fairport Harbor, OH (US); James J. Corbett, Highland Heights, OH (US)

(73) Assignee: Ranpak Corp., Concord Township, OH (US)

( * ) Notice: Subject to any disclaimer, the term of this patent is extended or adjusted under 35 U.S.C. 154(b) by 336 days.

(21) Appl. No.: 12/990,712

(22) PCT Filed: Jun. 5, 2009

(86) PCT No.: PCT/US2009/046391

§ 371 (c)(1),
(2), (4) Date: Nov. 2, 2010

(87) PCT Pub. No.: WO2009/149338

PCT Pub. Date: Dec. 10, 2009

(65) Prior Publication Data

US 2011/0041464 A1 Feb. 24, 2011

Related U.S. Application Data

(60) Provisional application No. 61/059,364, filed on Jun. 6, 2008.

(51) Int. Cl.
*B65B 7/00* (2006.01)

(52) U.S. Cl.
USPC ..... 53/416; 53/136.4; 53/377.8

(58) Field of Classification Search
USPC 53/136.4, 416, 419, 377.8, 378.3; 198/626.3, 198/626, 836.3; 493/475, 479
See application file for complete search history.

(56) References Cited

U.S. PATENT DOCUMENTS

| | | | | |
|---|---|---|---|---|
| 3,800,679 | A | 4/1974 | Bartelheimer | |
| 3,894,380 | A * | 7/1975 | Poulsen | 53/75 |
| 3,915,786 | A | 10/1975 | Collett et al. | |
| 3,954,550 | A | 5/1976 | Patterson | |
| 4,073,119 | A | 2/1978 | Nelson | |
| 4,317,319 | A * | 3/1982 | Price | 53/76 |
| 4,545,176 | A | 10/1985 | Marchetti | |
| 4,590,736 | A | 5/1986 | Marchetti | |
| 4,781,786 | A | 11/1988 | Lerner et al. | |
| 4,883,232 | A | 11/1989 | Marchetti | |
| 4,889,581 | A | 12/1989 | Ulrich et al. | |
| 4,955,177 | A * | 9/1990 | Lerner et al. | 53/136.4 |

(Continued)

OTHER PUBLICATIONS

International Search Report and Written Opinion of corresponding International Application No. PCT/US2009/046391, dated Sep. 9, 2009.

*Primary Examiner* — Hemant M Desai
(74) *Attorney, Agent, or Firm* — Renner, Otto, Boisselle & Sklar, LLP

(57) ABSTRACT

A method for clearing stalled containers in a taping or other container sealer includes the steps of (i) conveying a container to a sealing station, (ii) sealing the container with a sealer at the sealing station as the container travels through the sealing station, (iii) detecting a stalled container in the sealing station, and (iv) raising the sealer upon detection of a stalled container in the sealing station to relieve the stalled condition so that the container travels through the sealing station and is sealed by the sealer. Raising the sealer can clear the stalled container, thereby minimizing or eliminating events that require an operator's attention.

19 Claims, 2 Drawing Sheets

U.S. PATENT DOCUMENTS 5,121,586 A 6/1992 Focke
5,123,991 A 6/1992 Tsuda
5,223,075 A 6/1993 Sims
5,507,907 A * 4/1996 Kropp et al. ..... 156/350
5,511,362 A 4/1996 Morita et al.
5,730,827 A 3/1998 Sewell
5,735,101 A * 4/1998 Shing-Tak Lam ..... 53/136.1
6,004,424 A 12/1999 Faust
6,276,112 B1 8/2001 Mori et al.
7,140,165 B2 * 11/2006 Ventura et al. ..... 53/415
2004/0226268 A1 * 11/2004 Vinh Le ..... 53/491

* cited by examiner

SYSTEM AND METHOD FOR SEALING PACKING CONTAINERS

This application is a national phase of International Application No. PCT/US2009/046391, filed Jun. 5, 2009, and published in English as WO 2009/149338 on Dec. 10, 2009, which claims the benefit of U.S. Provisional Patent Application No. 61/059,364, filed Jun. 6, 2008, which are incorporated herein by reference.

FIELD OF THE INVENTION

The present invention is related to a system and method for sealing packing containers, and more particularly to a system and method for automatically applying packing tape or otherwise sealing a packing container.

BACKGROUND

In increasingly automated packaging systems, once an article has been placed in a container for shipment, a conveyor typically moves the container to an automated container closing and/or sealing assembly for closing the container and sealing it for shipment. The automated equipment also can apply a shipping label and/or the appropriate postage for the container.

One of the more common types of shipping containers is a cardboard box having one or more flaps that close an open side of the box. Once the box is ready to be sealed, automated assemblies can fold the flaps over the open side to close the box and then automatically seal the box for shipment, such as by taping the box closed. Automated assemblies that close the box and apply tape to hold the box closed can be referred to as automatic taping machines, and automated assemblies that just apply tape can be referred to as semi-automatic taping machines.

When the taping machine is sealing containers with a consistent height, a fixed-height tape-applying assembly applies tape to seal the containers. When sealing containers with different heights, an adjustable-height tape-applying assembly raises and lowers as needed to apply the tape and seal the containers.

One type of adjustable-height tape-applying assembly includes a pressure switch at an upstream end. When a container engages the pressure switch, the tape-applying assembly raises its height relative to the conveyor until the container no longer engages the pressure switch. The tape-applying assembly then proceeds to tape the container closed as it moves through or past the tape-applying assembly.

SUMMARY

The present invention provides a system and method for sealing a packing container that solves a problem with some prior adjustable-height taping assemblies where the container to be sealed catches on the tape-applying assembly and stalls or jams. The container does not progress past the taping assembly as it should. This can occur when a flap catches on part of the tape-applying assembly or when dunnage in the container creates a bulge at an upper end of the container, or when the taping assembly is below the appropriate height for that container, as a few examples. Such a situation typically would require an operator's attention both to recognize and correct the problem to relieve the stalled condition of the container.

The present invention solves the stalling problem by detecting the stalled condition automatically and taking action to resolve it. The present invention also alerts the operator when the actions taken failed to resolve the problem. And this solution is not limited to taping assemblies, but also applies to other types of adjustable-height container sealing mechanisms.

More particularly, the present invention provides a system and method that raises the taping or other sealing assembly or sealer under predetermined conditions, typically including one or more sensors detecting the presence of a container at two different times. Raising the sealer can clear the stalled container, thereby minimizing or eliminating events that require an operator's attention. The operator is alerted when the sealer reaches its maximum height without clearing the container, e.g., the sensor still detects the container at an upstream end of the sealer. Between raising the sealer and alerting the operator, the present invention provides systems and methods that minimize the time and attention required of the operator to ensure continued operation of the sealer.

Specifically, an exemplary system provided by the invention includes a conveyor that delivers a container to a sealing station, a sealer at the sealing station that seals the container closed as the container travels through the sealing station, a detector that detects a stalled container in the sealing station, and a sealer lift mechanism that raises the sealer upon detection of a stalled container in the sealing station to relieve the stalled condition of the container so that the container travels through the sealing station and is sealed by the sealer.

And an exemplary method provided by the invention includes the steps of conveying a container to a sealing station, sealing the container with a sealer at the sealing station as the container travels through the sealing station, detecting a stalled container in the sealing station, and raising the sealer upon detection of a stalled container in the sealing station to relieve the stalled condition so that the container travels through the sealing station and is sealed by the sealer.

The foregoing and other features of the invention are hereinafter fully described and particularly pointed out in the claims, the following description and the annexed drawings setting forth in detail several illustrative embodiments of the invention, such being indicative, however, of but a few of the various ways in which the principles of the invention may be employed.

DETAILED DESCRIPTION

Figure 1:
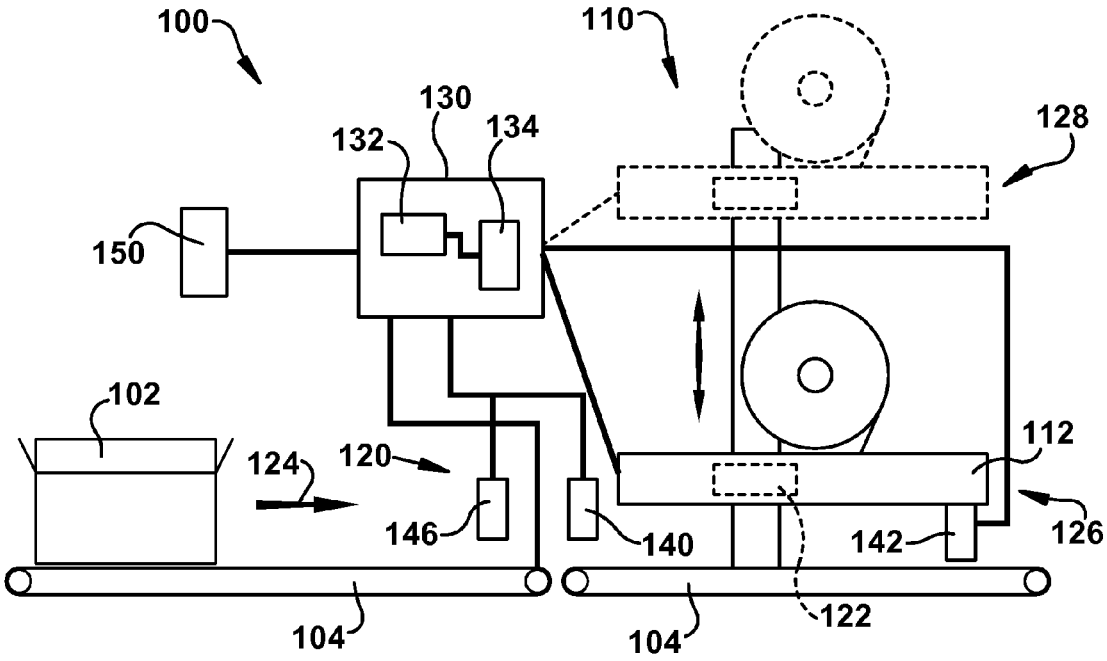
FIG. 1 is a schematic illustration of a container-sealing system provided in accordance with the present invention.
Figure 2:
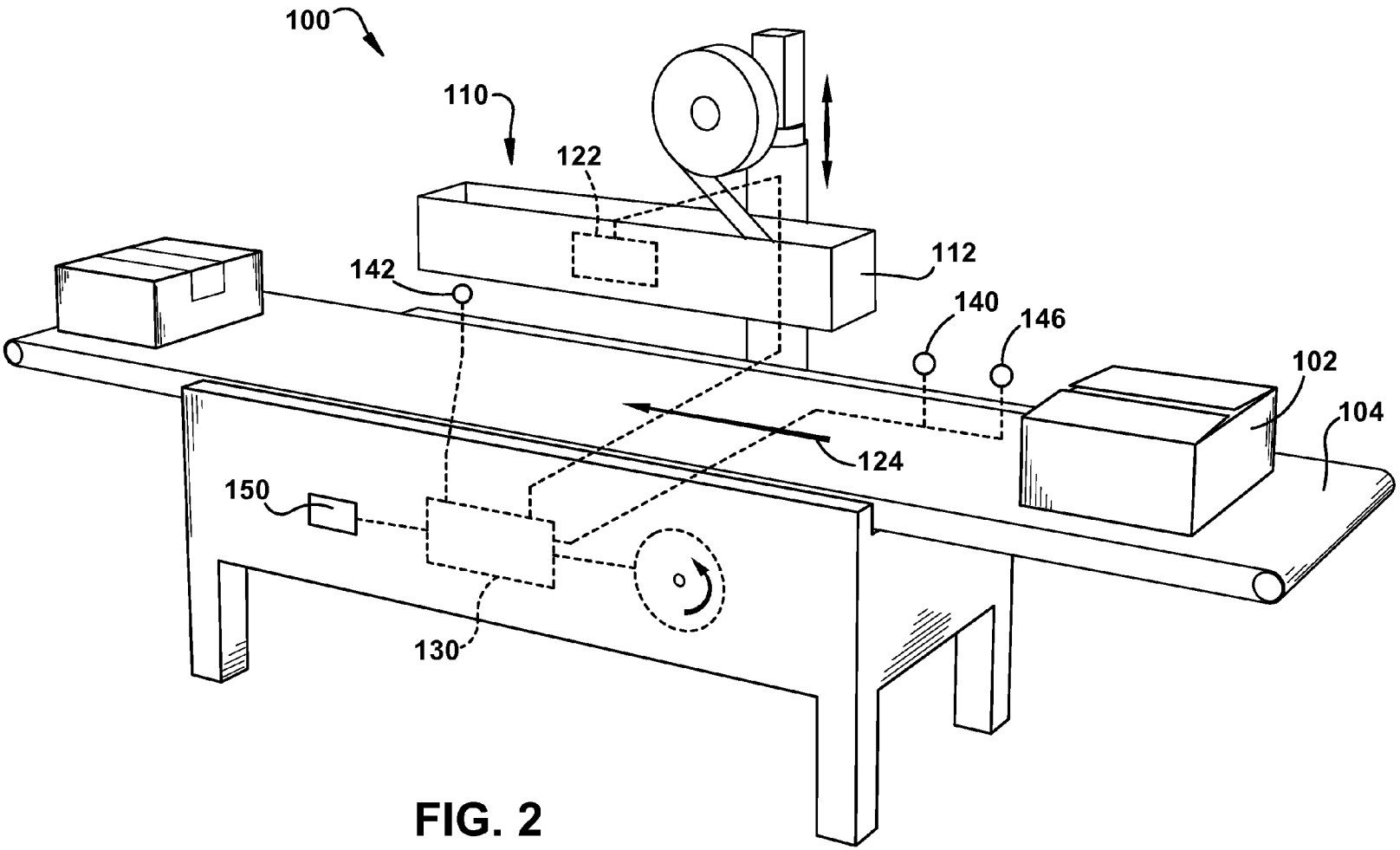
FIG. 2 is perspective view of an exemplary container-sealing system provided in accordance with the present invention.

The present invention solves the problem of stalled containers by automatically raising an adjustable-height taping or other sealing assembly. Referring to the drawings, the present invention provides, for example, a system 100 for sealing a packing container 102. The system 100 includes a conveyor 104 that delivers a container 102 to a sealing station 110. A sealer or sealing assembly 112 at the sealing station 110 seals the container 102 closed as the container travels through the sealing station 110. A detector 120 detects when a container 102 stalls in the sealing station 110 and a sealer lift mechanism 122 raises the sealer 112 upon detection of a stalled container. The system 100 raises the sealer 112 to relieve the stalled condition of the container 102 so that the container will travel through the sealing station 110 and be sealed by the sealer 112.

Packing containers typically are one of two types. One type is a shoebox-style container having an enclosure with an opening on one side and a separate lid that closes the open side of the enclosure. Another type of container is the regular slotted container or similar container having one or more flaps that fold over an open side of the container to close it. Suitable sealers for any container type are available to tape the container and seal it, apply adhesive, apply heat to activate an adhesive or similar compound to seal the container, etc.

The conveyor 104 that delivers the container 102 to the sealing station 110 can be any type of conveyor, including a roller or belt conveyor, or other transport device for moving a container 102 to the sealing station 110. The sealing station 110 typically has a conveyor that moves the container through the sealing station in an upstream-to-downstream direction 124. A centering mechanism (not shown) typically engages the sides of the container to center it on the conveyor. The conveyor within the sealing station can be a continuation of the conveyor that delivers the container to the sealing station.

The sealer lift mechanism 122 can include a chain drive, a hydraulic drive mechanism, or other drive mechanism that lifts the sealer 112 relative to an upper surface of the conveyor 104. The sealer 112 typically is moveable between a lower height position 126 above a conveyor surface and an upper height position 128 above the lower height position, the upper height position typically being a maximum height to which the sealer lift mechanism 122 can move the sealer 112.

To control movement of the sealer 112 and accordingly control the sealer lift mechanism 122, the system 100 can include a controller 130 connected to the detector 120 that controls the position of the sealer 112 in response to the detector detecting a stalled container in the sealing station 110. The controller 130 typically includes a processor 132, a memory 134, and one or more input and output connections to the detector 120 and the sealer lift mechanism 122, for example.

The controller controls the sealer lift mechanism 122 to move the sealer 112 toward the upper height position while predetermined criteria are satisfied. The predetermined criteria typically are satisfied when (a) the sealer 112 is not at the upper height position 128, and (b) one or both of the following conditions also apply. Those conditions include (i) the detector 120 detects a container 102 at a first time and at a second time that occurs a predetermined period after the first time, or (ii) the detector 120 includes a first sensor 140 that detects a container 102 at the first time and a second sensor 142 spaced from the first sensor 140 that does not detect the container by the second time. In the first condition (i), the detector 120 includes a sensor 140 that detects a container 102 that is stalled adjacent the sensor. The container 102 either does not move quick enough to completely clear the sensor 140 within the predetermined period of time, or the container 102 is stuck at that location.

Containers can get stuck or stalled in a number of ways, including by not being square to the direction of travel, having an overfull container with flaps or contents that catch on the sealer to retard, or delay passage of the container past the sensor 140. An overfull container that bulges in the middle could pass partially under the sealer before being stalled. The detector 120 can include both a first sensor 140 near an upstream end of the sealer 112 and a second sensor 142 spaced downstream of the first sensor 140. In the alternative condition (ii), the container 102 does not travel sufficiently quickly from the first sensor 140 to the second sensor 142 within the predetermined period of time. So this also indicates that the container 102 has stalled and its passage though the sealing station 110 has been retarded, even if the container has passed the first sensor 140.

While the predetermined criteria are satisfied, and a stalled container has been detected, the controller 130 can control the sealer lift mechanism 122 to repeatedly move the sealer 112 toward the upper height position in incremental steps at predetermined intervals. So, for example, while the predetermined criteria are satisfied, the controller 130 can control the sealer lift mechanism 122 to repeatedly move two centimeters at a time every fifteen seconds that the predetermined criteria are satisfied. Alternatively, while the predetermined criteria are satisfied the controller 130 can control the sealer lift mechanism 122 to continuously raise the sealer 112 toward the upper height position. When the predetermined criteria are no longer satisfied and the stalled condition of the container 102 has been relieved, the container will travel through the sealing station 110 and the sealer 112 will seal the container.

The predetermined time criteria can vary based on the size of the container, because a longer container will take more time to pass by a sensor and less time to reach a second sensor. Accordingly, the system 100 can also include a sensor 146 that identifies the container, whereby the controller 130 can determine the second time based on the container identification. This identification sensor 146 can be separate from or the same as the sensor 140 at the upstream end of the sealing station 110. The identifying sensor 146 can include a barcode reader or other indicia detector, a radio frequency identification device (RFID) or other means for identifying the container. The controller 130 can determine the length of the container from data in a look-up table stored in the memory 134, for example, to determine how long the container is. If the conveyor speed is known, the controller 130 can determine the second time based on the length of the container 102 and the speed of the conveyor 104. This is the predetermined time at which the container should clear the sensor 140 and/or travel to the second sensor 142.

If the predetermined criteria still are satisfied when the sealer has reached the upper position 128, the controller 130 signals the operator for assistance. So the controller 130 also is connectable to an output device 150. The controller 130 controls the output device 150 to signal an operator when (a) the sealer 112 is at the upper height position 128, and (b) at least one of (i) a sensor 140 detects a container at both the first time and the second time, or (ii) a first sensor 140 detects a container at the first time and a second sensor 142 spaced downstream from the first sensor does not detect the container by the second time. The output device 150 can provide a visual, audible, electronic or other signal to alert an operator. The output device 150 can be located remotely relative to the controller 130 and/or the sealer 112 or can be located locally in the same place as the controller 130 and/or the sealer 112.

The controller 130 can either be integral with the sealer 112 or be remotely located relative to the sealer. The conveyor 104 can be driven either continuously or intermittently as it delivers containers to the sealer 112. The controller 130 also can be connected to the conveyor 104 to control the conveyor or to monitor the speed of the conveyor. So the conveyor speed can be controlled to adjust for a temporarily stalled container, or to maintain a constant speed as containers of different weights enter and leave the conveyor, for example. Connections between the controller 130, the detector 120, the conveyor 104, and/or the sealer lift mechanism 122 can be continuous, intermittent through a wire, or wireless via infrared radio frequency or other signals in the electromagnetic spectrum.

An exemplary container sealing method employing the system provided by the invention includes the following steps: (a) conveying a container to a sealing station, (b) sealing the container with a sealer at the sealing station as the container travels through the sealing station, (c) detecting a stalled container in the sealing station, and (d) raising the sealer upon detection of a stalled container in the sealing station to relieve the stalled condition so that the container travels through the sealing station and is sealed by the sealer.

The raising step can include moving the sealer toward the upper height position while predetermined criteria are satisfied. As noted above, the predetermined criteria are satisfied when the sealer is not at the upper height position and a stalled container is detected.

The detecting step includes at least one of (i) detecting a container at a location at a first time and again at a second time that occurs a predetermined period after the first time, or (ii) detecting a container at a first location at the first time and failing to detect the container at a second location spaced downstream from the first location by the second time. Either variation indicates that the container is not progressing through the sealing station as fast as it should. The detecting step also can include the step of detecting a container at an upstream end of the sealing station, and detecting a container at a location downstream of the upstream end of the sealing station. Once a stalled container has been detected, other criteria can be used to determine when the stalled condition has been relieved.

If the detector 120 does not include the second sensor 142, the controller 130 can stop raising the sealer 112 when the press 140 no longer detects the container 102 (or the sealer reaches the upper height position, although this does not resolve the stalled condition). If the sensor no longer detects the container, the container is presumed to continue to travel through the sealing station 110. And if the detector 120 includes both the first sensor 140 and the second sensor 142, the controller can stop moving the sealer when the container reaches or passes the second sensor 142 (or the sealer reaches the upper height position).

The moving step includes repeatedly moving the sealer stepwise at predetermined intervals while the predetermined criteria are satisfied. Such as moving one centimeter every two seconds until the stalled condition is resolved. Alternatively, the moving step includes continuously moving the sealer while the predetermined criteria are satisfied. When the system 100 includes both the first sensor 140 and the second sensor 142, the incremental-movement should be used to minimize the chance that the sealer 112 will be raised too high to adequately seal the container. Otherwise, the method can include either incremental or continuous movement of the sealer toward the upper height position.

When both (a) the sealer has reached the upper height position, and (b) a stalled container is detected or the stalled condition has not been relieved, the method includes the step of signaling an operator to resolve the stalled condition. As discussed above, the method can include the step of identifying a container and determining the second time based on the container identification. The determining step can include determining the second time based on the length of the container, such as might be stored in memory, and the speed of the conveyor. The speed of the conveyor can be assumed to be constant or can be actively monitored and/or controlled. The conveying step can include driving a conveyor either continuously or intermittently. The method can also include monitoring the speed of the conveyor, controlling the speed of the conveyor, and closing one or more flaps of a container. The sealing step can include applying tape to a container, sealing with an adhesive, or applying heat to activate an adhesive to seal the container.

As mentioned above, some prior systems had a contact switch at an upstream end of the sealer. When a container pressed against the switch with sufficient force to close the switch, the sealer was raised until the switch cleared the container. If the container is not closed, however, upright flaps can exert enough force to close the switch, causing the sealer to rise above the closed height of the container. Then the sealer cannot properly seal the container. Alternatively, an over-full container with a bulging center might not close the switch before the leading edge moves under the sealer. The bulging center of the container could stall the container under the sealer without closing the switch to raise the sealer out of the way. The stalled condition would then require the attention of an operator. The system and method provided by the present invention avoid these problems, while also providing the ability to process different sizes of containers more quickly.

Although the invention has been shown and described with respect to a certain embodiment or embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer that performs the specified function of the described integer (i.e., that is functionally equivalent), even though not structurally equivalent to the disclosed structure that performs the function in the herein illustrated exemplary embodiment of the invention.

What is claimed is:

1. A system for sealing a packing container, comprising:

a conveyor that delivers a container to a sealing station;

a sealer at the sealing station that seals the container closed as the container travels through the sealing station;

a detector that detects a stalled container in the sealing station, where the detector includes one or more sensors;

a sealer lift mechanism that raises the sealer upon detection of a stalled container in the sealing station to relieve the stalled condition of the container so that the container travels through the sealing station and is sealed by the sealer, where the sealer is movable between a lower height position and an upper height position; and a controller connected to the detector and the sealer lift mechanism to control the sealer lift mechanism to raise the sealer based on a signal from the detector that indicates a stalled container in the sealing station; and the controller is operably to control the sealer lift mechanism to move the sealer toward the upper height position when the sealer is not at the upper height position.

2. A system as set forth in claim 1, wherein the detector includes a first sensor upstream of the sealer, and a second sensor spaced downstream of the first sensor.

3. A system as set forth in claim 1, wherein the lower height position is above a surface of the conveyor.

4. A system as set forth in claim 1, comprising an output device connectable to the controller, wherein the controller controls the output device to signal an operator when (a) the sealer is at the upper height position, and (b) at least one of (i) the detector includes a sensor that detects a container at both a first time and a second time after the first time, or (ii) the detector includes a first sensor that detects a container at the first time and a second sensor spaced downstream from the first sensor that does not detect the container by the second time.

5. A system as set forth in claim 1, comprising a sensor that identifies a container.

6. A system as set forth in claim 1, wherein the controller determines the second time based on the length of the container and the speed of the conveyor.

7. A system as set forth in claim 1, wherein the controller either is integral to the sealer or is remotely located relative to the sealer.

8. A system as set forth in claim 1, wherein the conveyor is driven either continuously or intermittently.

9. A system as set forth in claim 1, wherein the controller is connected to the conveyor to control the conveyor or to monitor the speed of the conveyor.

10. A container sealing method comprising the steps of:

conveying a container to a sealing station;

sealing the container with a sealer at the sealing station as the container travels through the sealing station;

detecting a stalled container in the sealing station; and raising the sealer upon detection of a stalled container in the sealing station to relieve the stalled condition so that the container travels through the sealing station and is sealed by the sealer, wherein the sealer is movable between a lower height position and an upper height position, and the raising step includes moving the sealer toward the upper height position while predetermined criteria are satisfied, the predetermined criteria being satisfied when the sealer is not at the upper height position and a stalled container is detected; and wherein the detecting step includes at least one of (i) detecting a container at a location at both a first time and at a second time that occurs a predetermined period after the first time, or (ii) detecting a container at a first location at the first time and failing to detect the container at a second location spaced downstream from the first location by the second time.

11. A method as set forth in claim 10, wherein the detecting step includes the step of detecting a container at an upstream end of the sealing station.

12. A method as set forth in claim 10, wherein the detecting step includes detecting a container at a location downstream of the upstream end of the sealing station.

13. A method as set forth in claim 10, wherein the moving step includes repeatedly moving the sealer stepwise at predetermined intervals while the predetermined criteria are satisfied.

14. A method as set forth in claim 10, wherein the moving step includes continuously moving the sealer while the predetermined criteria are satisfied.

15. A method as set forth in claim 10, comprising the step of signaling an operator when (a) the sealer is at the upper height position, and (b) a stalled container is detected.

16. A method as set forth in claim 10, comprising the steps of identifying a container and determining the second time based on the container identification.

17. A method as set forth in claim 16, wherein the determining step includes determining the second time based on the length of the container and the speed of the conveyor.

18. A method as set forth in claim 10, wherein the conveying step includes driving a conveyor either continuously or intermittently.

19. A method as set forth in claim 10, comprising the step of monitoring the speed of the conveyor.

* * * * *

UNITED STATES PATENT AND TRADEMARK OFFICE

CERTIFICATE OF CORRECTION

PATENT NO. : 8,499,532 B2
APPLICATION NO. : 12/990712
DATED : August 6, 2013
INVENTOR(S) : Kevin William Park et al.

It is certified that error appears in the above-identified patent and that said Letters Patent is hereby corrected as shown below:

IN THE CLAIMS:

Claim 1, column 6, line 52, change "operably" to --operable--.

Signed and Sealed this
Fifth Day of November, 2013

Teresa Stanek Rea

Teresa Stanek Rea
*Deputy Director of the United States Patent and Trademark Office*